United States Patent [19]

Brown

[11] 4,311,402

[45] Jan. 19, 1982

[54] CONTAINER FOR LIPSTICK AND LIKE PRODUCTS

[75] Inventor: Gilbert Brown, Poole, England

[73] Assignee: Edward Webster Limited, West Howe, England

[21] Appl. No.: 115,387

[22] Filed: Jan. 25, 1980

[30] Foreign Application Priority Data

Jan. 27, 1979 [GB] United Kingdom ..... 02952/79

[51] Int. Cl.[3] ..... A45D 40/12; A45D 40/06

[52] U.S. Cl. ..... 401/78; 401/53; 401/68; 401/98

[58] Field of Search ..... 401/60, 61, 68, 74, 401/75, 77, 78, 86, 87, 53, 116; 206/385, 45.15; 132/79 C, 88.7; 222/80, 390, 541

[56] References Cited

U.S. PATENT DOCUMENTS

| | | | |
|---|---|---|---|
| 769,928 | 9/1904 | Ziegler | 222/80 |
| 2,072,662 | 3/1937 | Abbots | 401/86 X |
| 2,506,984 | 5/1950 | Anderson | 401/86 |
| 3,547,550 | 12/1970 | Gruska | 401/78 |
| 4,108,558 | 8/1978 | Radice et al. | 401/78 |

FOREIGN PATENT DOCUMENTS

| | | | |
|---|---|---|---|
| 773504 | 4/1957 | United Kingdom | 401/78 |
| 1298934 | 12/1972 | United Kingdom | 401/78 |

*Primary Examiner*—Steven A. Bratlie

*Attorney, Agent, or Firm*—Scrivener, Clarke, Scrivener and Johnson

[57] ABSTRACT

In a lipstick container of basically orthodox type, comprising a body and sleeve with co-operating axial and helical slots to impart axial movement to a lipstick-bearing cup on relative rotation, there is a breakable web across one of the slots, preferably the axial one, acting to obstruct inadvertent movement of the cup so that the container can be shipped and displayed for sale with the lipstick projecting from the body and visible through a transparent cover. Subsequent deliberate action by the user to retract or advance the lipstick will break the web.

7 Claims, 5 Drawing Figures

CONTAINER FOR LIPSTICK AND LIKE PRODUCTS

SPECIFIC DESCRIPTION

This invention relates to containers for lipstick and like products. The most widely known form of container comprises a body having a tubular portion in which there is slidably mounted a cup or so-called godet which carries the lipstick, and radial pegs on the godet co-operate with axial slots in the tubular portion of the body and helical slots in a surrounding sleeve or so-called spiral, so that rotation of the spiral in relation to the body by the user advances or retracts the lipstick axially. In its fully retracted position the top of the lipstick is usually below or level with the top of the body. A cover fits over the resulting assembly and its skirt is frictionally held on a region of the body below the spiral.

Current selling methods make it desirable for the purchaser to be able to see the exact colour of the lipstick she is buying. It has therefore been proposed to make the removable cover, or at least the upper end of it, transparent. This is not enough unless the lipstick when in the shops, is advanced above its fully retracted position, so that it projects at least partially a predetermined distance above the top of the body; the cover can be made correspondingly taller than it otherwise would be. However this solution to the problem brings its own problems in shipping and handling. If the container is despatched from the cosmetic manufacturer's premises with the lipstick already partially projecting, vibration can easily lead to it projecting further and being damaged by contact with the cover, or becoming retracted and consequently invisible.

It has therefore been proposed to provide a 'hesitation' in the axial slots in the body, i.e. a transverse part of the slot joining upper and lower mutually offset axial portions; the container is despatched with the lipstick partially advanced and the peg on the godet held in this transverse portion. However, this 'hesitation' in the movement is confusing to the purchaser during her normal day-to-day use of the lipstick.

The aim of the present invention is to provide an improved way of locating the godet in a lipstick container (by this phrase we mean to include a container for similar products such as salves or ointments in stick form) in an accurately determined intermediate position with the godet fully disposed within the body and the tip of the lipstick advanced so as to be visible through a transparent or partially transparent cover for subsequent handling and shipping up to the point of sale.

According to the invention we achieve this by providing a breakable web across at least one of the slots at the appropriate point, to obstruct movement of the associated peg and thereby provide a stop for the godet, this web being strong enough to locate the godet when it is inserted and/or retracted during manufacture, but capable of being easily broken by a conscious or determined action by the user to advance and/or retract the lipstick.

Most simply the web is across the vertical slot in the body (or across one or each of these slots where there are more than one). It could however equally well be provided across the helical slot, or one or each of the helical slots, in the sleeve or 'spiral', although where the parts are mouldings in synthetic resin, this version may presnt production problems.

Thus during manufacture, when the stick has been inserted in the godet (possibly by directly casting it into a sheath mounted on the godet) with the godet in its fully advanced position, the web provides a convenient positive stop to which the godet can be retracted, possibly by automatic machinery.

Normally the lipstick container will be marketed with the peg on the godet immediately above the web. When the purchaser first uses the lipstick she can advance it above this position for use and then, before replacing the cover, retracts the lipstick in the normal way and in doing so breaks the web. The broken web will fall to the bottom of the interior of the body, out of harm's way.

The invention is equally applicable where the helical slot and the axial slot are interchanged, i.e. the latter is in the sleeve and the former in the body.

Instead of being just above the web, the peg could be just below it. Thus when the user first wants to use the lipstick she advances it in the usual way, breaking the web as she does so; however this may lead to problems if the web then fell into the mechanism. Within the scope of the invention it would be possible to provide webs both above and below the peg, although this could present problems in initial assembly.

We are of course aware that it has been proposed to provide a breakable web across the extreme upper end of the slot, but this was for an entirely different purpose connected with complete removal of the godet in a lipstick container of the replaceable cartridge type.

Inadvertent movement of the godet away from the pre-set position during handling and shipping may be prevented by ensuring that there is sufficient friction between the spiral and the body. Alternatively the transparent cover may be arranged so that, whilst its lower edge frictionally grips the base of the body in the usual way, the interior of its upper part grips the upper part of the spiral. If the latter grip is made significantly tighter than the former, the cover can be used to rotate the spiral and thereby retract or advance the stick without removing the cover.

The invention will now be described by way of example with reference to the accompanying drawings, in which.

The body of the container, shown at 1, is of basically orthodox form, having a base 2 and a tubular portion 3 in which there are two diametrically opposed axially extending slots, of which one is visible at 6, with the usual lateral locking notches 4 and 5 at the top and bottom ends. The body is moulded from a suitable synthetic resin, such as polystyrene.

Figure 2:
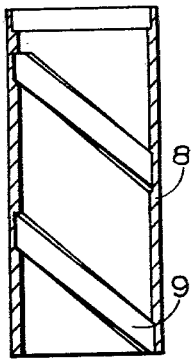
FIG. 2 is a section through the associated sleeve or 'spiral'.
Figure 5:
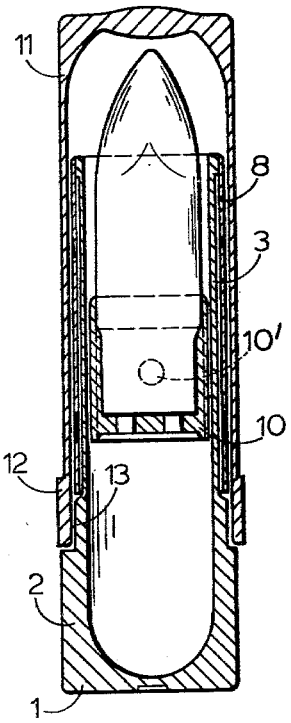
FIG. 5 is a section through the complete lipstick container assembly, showing the lipstick in the 'shipping' position.
Figure 1:
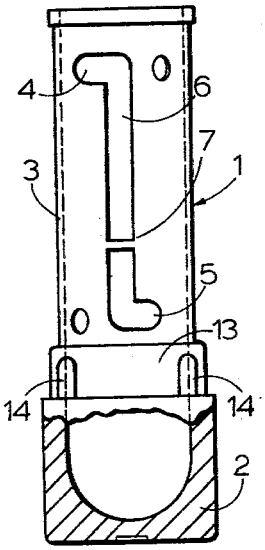
FIG. 1 is an axial section through a lipstick body of basically orthodox form but modified to incorporate the invention.

About one third of the way from the bottom of the slot there is moulded an integral web 7 extending across the slot. In the example shown it is 0.3 mm thick and 0.6 mm in vertical height; its length is the width of the slot, which is 3 mm. The 'spiral' or sleeve 8 containing the helical slots 9 is shown in FIG. 2 and is of known form, as is the godet 10 (FIG. 5), which has pegs, one of which is visible at 10' in FIG. 5, projecting through the slots 6 into the helical slots 9. As can be seen in FIG. 1, the web 7 is located as to be engageable by a projection 10' with the godet or cup 10 fully within the tubular portion 3 but advanced beyond its fully retracted position so that the tip of the lipstick projects a predetermined distance above the upper end of the body of the container, as can be seen in FIG. 5.

Figure 3:
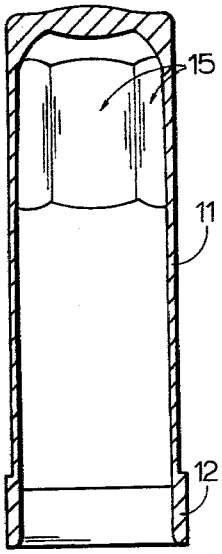
FIGS. 3 and 4 are respectively an axial section and a transverse section through the associated transparent cover.
Figure 4:
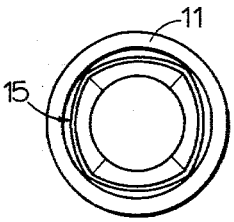

The transparent cover 11 (FIGS. 3 and 4) has a skirt 12 which is of a size to grip frictionally a portion 13 of the upper part of the base 2 of the body to hold the cover in place in the usual way. Again, in a known way, this portion of the base has circumferentially spaced raised ribs 14 to provide the grip.

In addition, however, the cover 11 has, over a restricted length of its upper part, an internal shape which, instead of being circular, is made up of intersecting arcs 15 of dimensions such that, when the cover is fitted in place on the container, this portion of the cover frictionally grips the upper end of the sleeve 8. This gives added security against inadvertent relative rotation of the sleeve and body under the effects of vibration during handling. Furthermore, if the frictional grip on the sleeve 8 is made tighter than that on the body 1, it makes it possible for personnel in the lipstick manufacturing plant or despatch department, or indeed the user if she so wishes, to rotate the sleeve deliberately, to advance or retract the lipstick, without removing the cover at all. This might be of advantage in the manufacturing plant in allowing the lipstick container to be assembled in the fully retracted position, and the cover to be fitted, and then the lipstick advanced up to the breakable web, thereby obviating the danger of damage that could arise if the cover is fitted whilst the lipstick is already partially projecting.

What is claimed is:

1. In a container for lipstick and like products comprising a body having a tubular portion, a cup slidably mounted in said tubular portion of said body for axial movement therein, a sleeve coaxial with said tubular portion and manually rotatable relative thereto, said sleeve and said tubular portion of said body having therein respective first and second slots having axial components, a projection on said cup co-operating with both of said slots, and said slots being substantially inclined with respect to each other whereby relative rotation of said sleeve and body results in axial movement of said cup, the improvement comprising a breakable web at an intermediate position in the length of one of said slots, said web being engageable by a projection on said cup to obstruct inadvertent movement of said cup but being breakable by said projection clear of said slot on a manually applied relative rotation of said body and sleeve, said intermediate position of said web being accurately determined such that when said projection engages said web said cup is fully disposed within the tubular portion of said body and said lipstick is advanced above its fully retracted position so that its tip projects a predetermined distance above the top of said body.

2. In the container set forth in claim 1 wherein said web extends fully across that slot in which it is present.

3. In the container set forth in claim 1 wherein one of said slots extends axially and the other extends helically, and said web is in said axially extending slot.

4. In the container set forth in claim 3 wherein said axially extending slot is in said tubular portion of said body.

5. In the container set forth in claim 4 wherein said body is of moulded plastics material and said web is moulded integrally therein.

6. In the container set forth in claim 1 including a cover, said cover fitting frictionally onto said body to enclose said tubular portion thereof, said cover being at least partially transparent.

7. In the container set forth in claim 6 wherein said cover also frictionally engages said sleeve.

* * * * *